US005429565A

United States Patent [19]

Hagg et al.

[11] Patent Number: 5,429,565

[45] Date of Patent: Jul. 4, 1995

[54] STRENGTH EXERCISE APPARATUS FOR USE WITH STATIONARY BICYCLES

[75] Inventors: Vernon A. Hagg, 5245 Heritage Hills Dr., Bloomington, Minn. 55437; David W. Wood, Maple Plain, Minn.

[73] Assignee: Vernon A. Hagg, Bloomington, Minn.

[21] Appl. No.: 283,068

[22] Filed: Jul. 29, 1994

[51] Int. Cl.[6] ..... A63B 22/06; A63B 21/02

[52] U.S. Cl. ..... 482/57; 482/908; 482/148; 482/123

[58] Field of Search ..... 482/55, 39, 69, 24, 482/96, 121, 129, 130, 908, 57, 122, 123, 126

[56] References Cited

U.S. PATENT DOCUMENTS

| | | | |
|---|---|---|---|
| 511,251 | 12/1893 | Pickles . | |
| 725,876 | 4/1903 | Roche . | |
| 1,307,905 | 6/1919 | Hendrickson . | |
| 1,691,092 | 11/1928 | Titus . | |
| 2,109,188 | 2/1938 | Bajanova | 482/69 |
| 3,077,613 | 2/1963 | Mayer | 482/24 |
| 3,709,487 | 1/1973 | Walker . | |
| 4,077,626 | 3/1978 | Newman . | |
| 4,313,602 | 2/1982 | Sullivan . | |
| 4,373,716 | 2/1983 | Pagani . | |
| 4,403,773 | 9/1983 | Swann . | |
| 4,478,413 | 10/1984 | Siwula . | |
| 4,850,587 | 7/1989 | Lin . | |
| 5,013,035 | 5/1991 | Nathaniel . | |
| 5,024,433 | 6/1991 | Mosberg | 482/96 |
| 5,029,848 | 7/1991 | Sleamaker | 482/55 |
| 5,090,694 | 2/1992 | Pauls et al. . | |
| 5,178,596 | 1/1993 | McIntire . | |

FOREIGN PATENT DOCUMENTS

| | | | |
|---|---|---|---|
| 0618746 | 4/1961 | Canada | 482/39 |

*Primary Examiner*—Stephen R. Crow
*Attorney, Agent, or Firm*—Peterson, Wicks, Nemer & Kamrath

[57] ABSTRACT

Apparatus (10) is disclosed including first and second supports (24) for supporting a stationary bicycle, with the supports (24) secured at adjustable longitudinal locations between first and second longitudinal rails (12). Cords (50) having grips (52, 54) on the opposite ends thereof are adjustably and slideably secured intermediate their ends at any location intermediate the ends of the longitudinal rails (12) by pivotable cam devices (60) slideable and pivotable in upper channels of the rails (12). Additionally, the pivotable cam devices (60) allow the lengths of the ends of the cords (50) to be adjusted relative to the rails (12). Thus, while pedaling and/or supported on the stationary bicycle, the user can exercise his upper body by stretching the cords (50) extending at various angles from locations in front, behind, and vertically below the user and with the desired tension depending upon the length of the cords (50) relative to the rails (12).

19 Claims, 2 Drawing Sheets

STRENGTH EXERCISE APPARATUS FOR USE WITH STATIONARY BICYCLES

BACKGROUND

The present invention generally relates to exercise apparatus, specifically to upper body exercise apparatus, and particularly to upper body exercise apparatus for use with stationary bicycles.

Pound for pound, muscle burns 25 times more calories than fat. Specifically, one pound of muscle uses about 350–500 calories per week to survive while a pound of fat only needs about 14 calories per week to survive. Thus, increasing muscle composition of the body increases the body's ability to burn calories. To keep weight off, one needs to keep muscle on. Losing fat is good while losing muscle is not. Strength exercise adds muscle and keeps calories from turning to fat plus increasing bone density. Because 65% of the body's muscles are located in the upper body, upper body exercise is clearly desired. Furthermore, there is less risk of stressing the cardiovascular system when the exercise workload is spread over more muscle groups including those in the upper body.

Stationary bicycles have been a popular form of exercise especially in areas where weather is a factor in preventing outdoor activities. Many stationary bicycles have stationary handle bars and have no provisions for upper body exercise. Other stationary bicycles incorporate handle bars either free from or tied to the foot pedal crank, with upper body exertion being generally limited to a pull/push parallel movement. A few stationary bicycles include arms behind the user and pivotable in generally vertical planes and having pull cords extending from their outer ends which operate a resistance loading device. Such bicycles including resistance loading devices are considerably more expensive than other stationary bicycles and thus are not as commonly owned by individual consumers and generally provide exertion on the muscles of the arms, with upper body exertion generally being limited to a push/pull parallel movement.

Thus, a need exists for an apparatus for exercising the upper body of a user while utilizing a stationary bicycle, with such exercising apparatus being relatively inexpensive, offering substantial variance in upper body exercise, and which otherwise overcomes the disadvantages and shortcomings of prior stationary bicycles.

SUMMARY

The present invention solves this need and other problems in the field of exercising apparatus by providing, in the most preferred form, a cord which is slideably and adjustably secured to a longitudinal rail at any location intermediate the ends of the longitudinal rail. In a further aspect of the present invention, the length of the cord from the longitudinal rail is adjustable and in the most preferred form is adjustable by the same device allowing adjustment of the securement location. In another aspect of the present invention, the apparatus includes two longitudinal rails including supports adjustably extending therebetween for receipt of the legs of a stationary bicycle.

Additionally, the present invention provides a device including a channel cam for slideably and adjustably securing the cord to the longitudinal rail at any desired longitudinal position and an integral cord cam for adjusting the length of the cord relative to the longitudinal rail.

It is thus an object of the present invention to provide a novel apparatus for exercising the upper body of a user. It is further an object of the present invention to provide such novel upper body exercising apparatus for use with stationary bicycles or the like.

It is further an object of the present invention to provide such novel upper body exercising apparatus which can be packaged and shipped in a relatively small container.

It is further an object of the present invention to provide such novel upper body exercising apparatus which is readily adjustable for use with existing exercise equipment.

It is further an object of the present invention to provide such novel upper body exercising apparatus providing considerable variation to correctly exercise different muscles with proper motions.

It is further an object of the present invention to provide such novel upper body exercising apparatus which can be easily adjusted to provide differing exercise motion without requiring disassembly.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
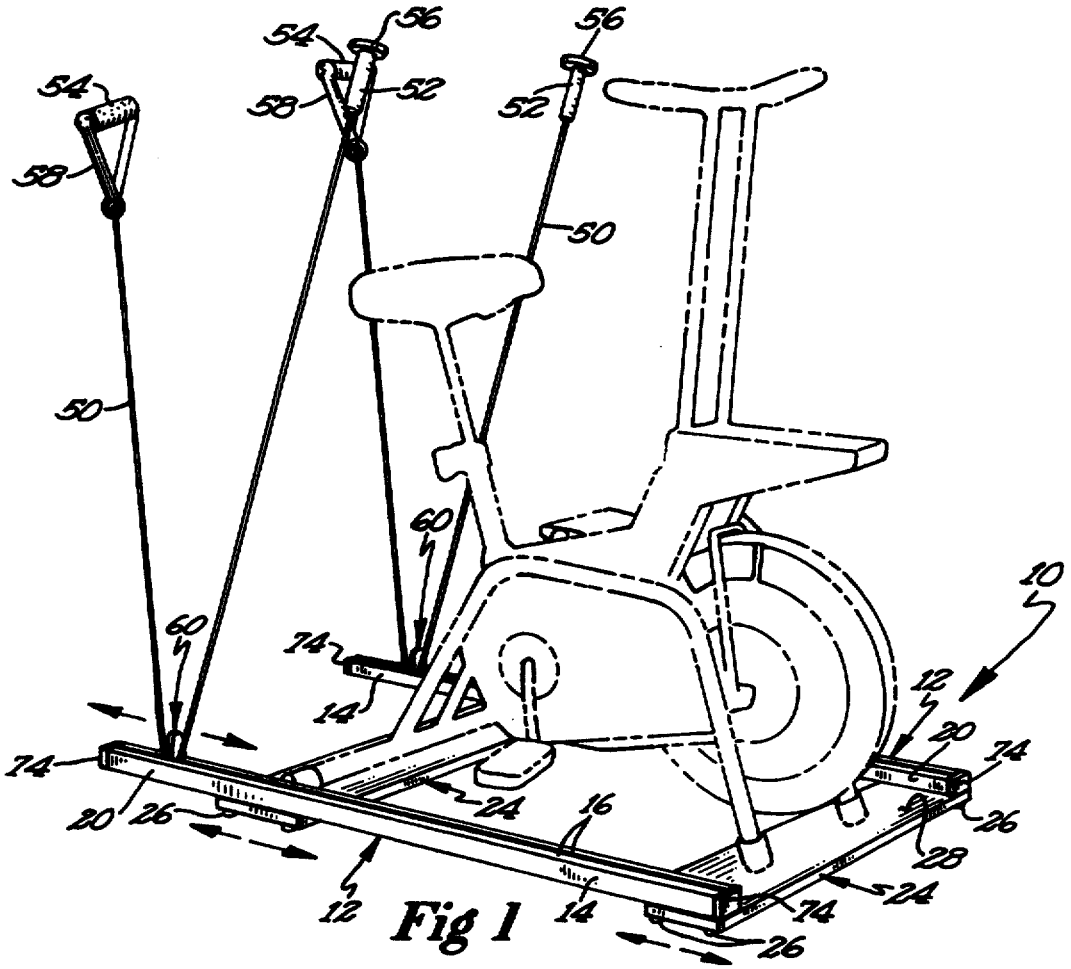
FIG. 1 shows a perspective view of the upper body exercising apparatus according to the preferred teachings of the present invention, with a stationary bicycle supported thereon being shown in phantom.
Figure 2:
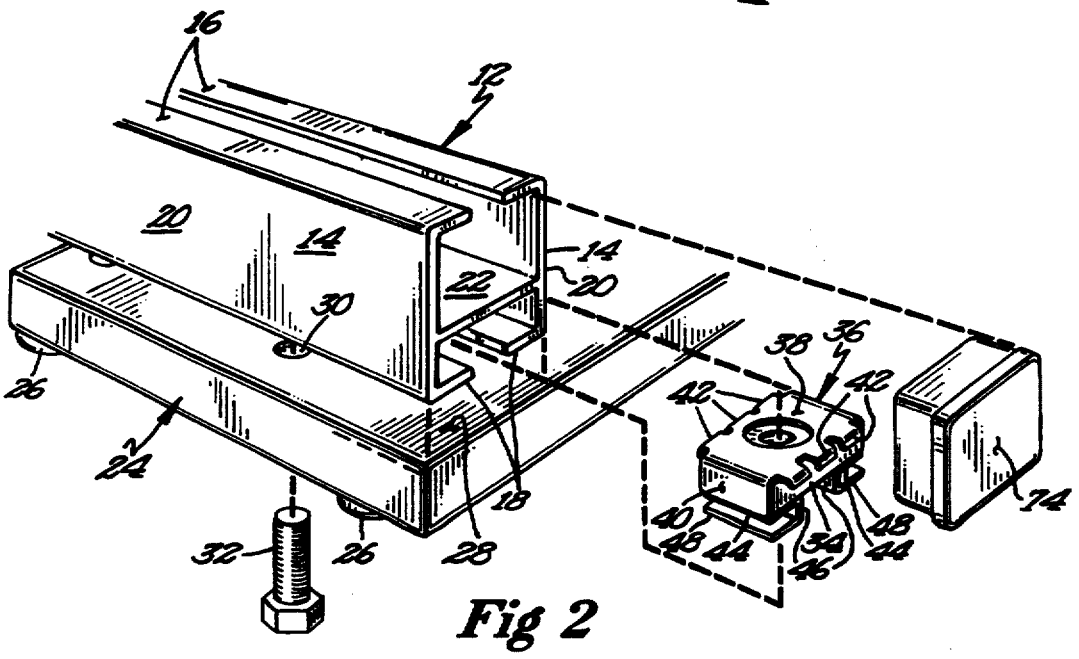
FIG. 2 shows a partial, exploded perspective view of the apparatus of FIG. 1.
Figure 3:
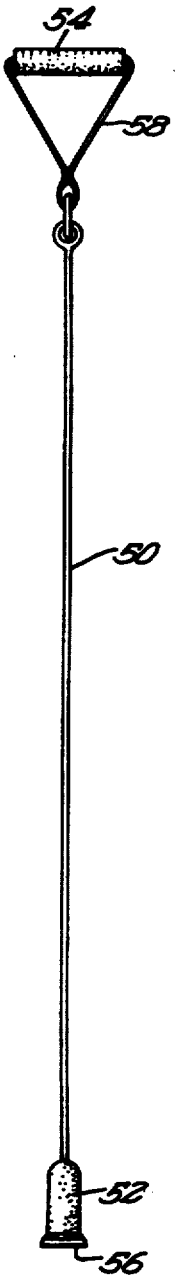
FIG. 3 shows an elevational view of the cord utilized in the apparatus of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "upper", "lower", "height", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the invention.

DESCRIPTION

An apparatus for exercising the upper body of a user according to the preferred teachings of the present invention utilized with a stationary bicycle is shown in the drawings and generally designated 10. Generally, apparatus 10 includes first and second, spaced, parallel longitudinal rails 12 of an identical construction and having first and second ends. In the most preferred form, longitudinal rails 12 are lightweight, aluminum extrusions and generally include upper and lower C-shaped channels. Specifically, rails 12 generally include first and second C-shaped members 14 which are spaced and face each other. C-shaped members 14 each include first and second legs 16 and 18 which extend perpendicularly from the opposite ends of a vertical central, side portion 20. Rails 12 further include a connecting portion 22 extending generally perpendicularly between central portions 20 of the first and second C-shaped members 14 parallel to, spaced from, and intermediate legs 16 and 18. The length of connecting portion 22 is greater than the combined length of legs 16 or the combined length of legs 18 of first and second C-shaped members 14 such that the free edges of legs 16 and 18 are spaced from each other. Thus, the upper channel includes a longitudinally extending hollow interior defined by side portions 20, connecting portion 22 and legs 16 and having a constant width in the most preferred form. Rails 12 each further include a longitudinally extending opening to the hollow interior of the upper channel defined by the lateral spacing between legs 16 and having a width less than the width of the hollow interior. Likewise, a longitudinal slot is defined between legs 18 opening to the longitudinally extending hollow interior of the lower channel defined by side portions 20, connecting portion 22 and legs 18 and having a constant width in the most preferred form. It can be appreciated that the widths of the upper and lower channels can be the same as shown or can be different.

Apparatus 10 further includes a support 24 of an area for receipt of the legs of a stationary bicycle. In the most preferred form, two supports 24 are provided, with supports 24 in the most preferred form including suitable, non slip, non marring floor engaging feet 26 attached to the lower surface thereof and a suitable non slip bicycle engaging surface 28 on the upper surface thereof. Surface 28 can be integrally formed on support 24, can be in the form of a mat suitably adhered to the upper surface of support 24, or can be otherwise formed. Supports 24 can be formed of any suitable material such as wood, plastic, or the like.

Apparatus 10 further includes suitable provisions for removably securing supports 24 between longitudinal rails 12 at adjustable, longitudinal locations. In the most preferred form, securement apertures 30 are formed in supports 24 adjacent the opposite ends thereof. Bolts 32 can be extended through apertures 30 of supports 24 and intermediate legs 18 and into the lower C-shaped channels of longitudinal rails 12 and threaded into a nut 34 non-rotatably received in the lower C-shaped channel. In the most preferred form, nuts 34 are non-rotatably and adjustably held in the lower C-shaped channels by a holder 36 formed of stamped and bent sheet metal. In particular, holder 36 includes a central portion 38 having an aperture formed therein for passage of the shank of bolts 32. Legs 40 extend generally perpendicularly downward from the opposite side edges of central portion 38 at a spacing generally equal to the width of nut 34. Flanges 42 extend generally perpendicularly downward from the opposite end edges of central portion 38 at a spacing generally equal to the length of nut 34. Legs 40 integrally terminate in inwardly extending lips 42 located parallel to central portion 38 at a spacing generally equal to the height of nut 34. The spacing between the inner edges of lips 42 is generally equal to the spacing between legs 18 and generally equal to or greater than the diameter of the shank of bolt 32 allowing the shank of bolt 32 to pass therebetween. The inner edges of lips 42 integrally terminate in downwardly extending, parallel extensions 46. The lower edges of extensions 46 integrally terminate in outwardly extending flanges 48 extending generally parallel to lips 42 and central portions 38. In the most preferred form, nut 34 and holder 36 are purchased parts.

When flanges 48 are squeezed together, nut 34 and holder 36 can be slid through the end of longitudinal rail 12 and into the lower C-shape channel, with flanges 48 positioned outside of legs 18. When at the desired position, flanges 48 can be released such that legs 18 are frictionally captured by lips 44, extensions 46, and flanges 48 to hold nut 34 and holder 36 at that position. With nuts 34 held in position in rails 12, supports 24 can be positioned to extend between longitudinal rails 12 with apertures 30 aligned with nuts 34. At that time, bolts 32 can be extended through apertures 30 and threaded into nuts 34 and tightened to hold longitudinal rails 12 and supports 24 in a right parallelepiped arrangement. It can then be appreciated that supports 24 can be adjustably positioned to be spaced a distance corresponding to the spacing of the legs of the particular stationary bicycle to be utilized with apparatus 10 according to the preferred teachings of the present invention.

Apparatus 10 further includes an elongated, stretchable, elastic cord 50 having grips 52 and 54 of different types on opposite ends thereof. The diameter of cord 50 is equal to or less than the width of the longitudinally extending opening or spacing between legs 16 of the upper channels of rails 12. Grip 52 is of the bicycle type having a centerline parallel to the centerline of cord 50. Grip 52 includes an annular, radial flange 56 at the outer end thereof. In the most preferred form, grip 52 is hollow and is slideably received on cord 50, with grip 52 being retained on cord 50 by a knot tied on the end of cord 52 which abuts with a portion of grip 52 inside of grip 52. Grip 54 is of a yoke or ring-strap type having a centerline generally perpendicular to the centerline of cord 50. In the preferred form, grip 54 is slideably received on a short strap 58 having its opposite ends secured such as by tying to the end of cord 50 opposite grip 52. In the preferred form, grips 52 and 54 have a foam covering for softness to eliminate irritation to the hands and for preventing slippage. Grips 52 and 54 can be used for hand/finger squeezing exercises. In the most preferred form, cord 50 and grips 52 and 54 are purchased parts.

Figure 4:
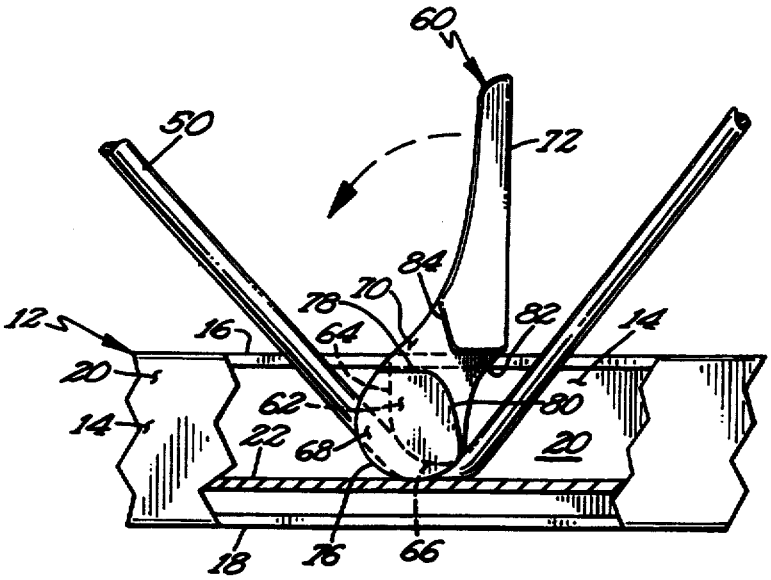
FIGS. 4 and 5 show partial side elevational views of the apparatus of FIG. 1 with the pivotable cam device located in first and second positions, with portions broken away to show constructional details.
Figure 5:
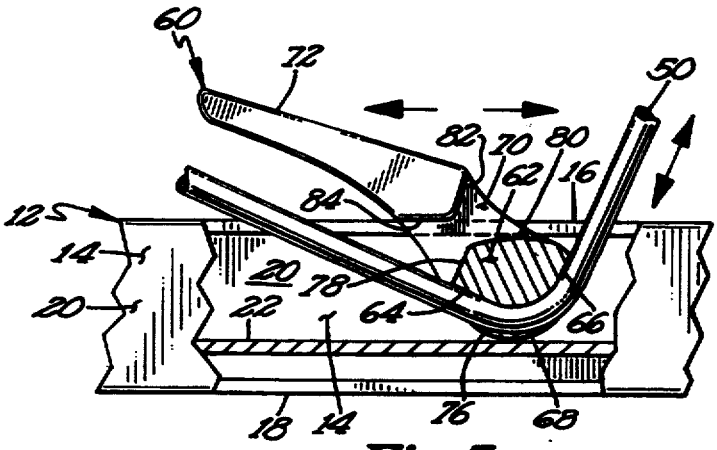
Figure 6:
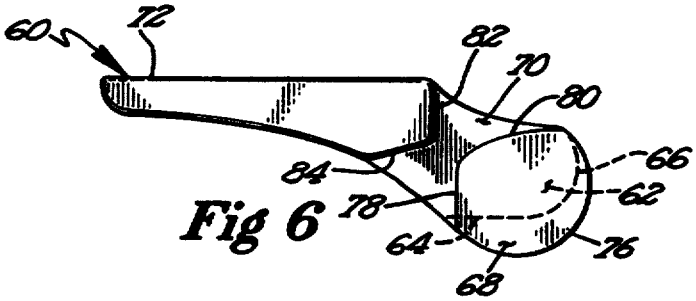
FIG. 6 shows a side elevational view of the pivotable cam device utilized in the apparatus of FIG. 1.

Apparatus 10 further comprises provisions for adjusting the length and/or the position of cord 50 relative to rails 12. In a first preferred form, a pivotable cam device 60 is provided as best seen in FIGS. 4 and 5. Specifically, a cord length adjustment cam 62 is provided including a first portion 64 and a second portion 66 rotatable relative to rails 12. Additionally, first and second cord position adjustment channel cams 68 are integrally provided on opposite sides of cam 62, with cams 68 (and cam 62 integrally secured therebetween) pivotable between a first position as best seen in FIG. 4 and a second position as best seen in FIG. 5. Cams 68 each generally include a first arcuate portion 76 extending approximately over one-half of the periphery of cams 68, a second planar portion 78 extending from one end of first portion 76, and a third portion 80 extending between the opposite ends of first and second portions 76 and 78. The spacing between portion 78 and the diametric opposite point of portion 76 is generally equal to the spacing and for binding between legs 16 and connecting portion 22 of the hollow interior of the upper channel of rails 12. In the most preferred form, the spacing between portion 78 and the diametric opposite point of portion 76 is slightly less than the spacing between legs 16 and connecting portion 22, with the combined spacing between portion 78 and the diametric opposite point of portion 76 and cord 50 thereover being such to bind between legs 16 and connecting portion 22 of the hollow interior of the upper channel of rails 12. The spacing between portion 80 and the diametric opposite point of portion 76 is less than and for sliding between legs 16 and connecting portion 22 of the hollow interior of the upper channel of rails 12.

In the first position of cams 68 as shown in FIG. 4, portion 66 is located at a spacing from connecting portion 22 a distance less than the unstretched diameter of cord 50, with cord 50 being bound between portion 66 and connecting portion 22 to prevent sliding of cord 50. In the most preferred form, connecting portion 22 can include tracks or the like to help center and hold cord 50 relative to cam 62. Cams 68 in the first, locked position as shown in FIG. 4 are arranged such that portions 76 and 78 (in combination with cord 50 in the most preferred form) are bound in the upper channel of rails 12. In the second position of cams 68 as shown in FIG. 5, portion 64 is positioned relative to connecting portion 22 at a spacing greater than the diameter of cord 50 and allowing cord 50 to slide relative to cam 62. Cams 68 in the second, unlocked position as shown in FIG. 5 are arranged such that portions 76, 78, and 80 are not bound in the upper channel of rails 12 but rather cams 68 (and cam 62 integrally secured therebetween) are free to slide in the upper channel of rails 12.

Cam device 60 further includes a neck 70 extending from cam 62 radially opposite to portions 64 and 66 and having a thickness less than or equal to the spacing between legs 16 for passage therebetween. Neck 70 terminates in a handle 72 located outside of rails 12 and the upper C-shaped channel thereof. Handle 72 is of a shape and size for manipulation by either the hands or feet of the user. Handle 72 generally includes first planar portions 82 on the opposite sides of neck 70 and arranged in a parallel, spaced, and offset relation from portions 78 of cams 68. In particular, the spacing between portions 78 and 82 is generally equal to the thickness of legs 16 and the offset between portions 78 and 82 is greater than and in the most preferred form is double the thickness of legs 16. Handle 72 further includes second planar portions 84 on the opposite sides of neck 70 and arranged at an obtuse angle in the order of 110° from first planar portions 82.

In operation of cam device 60 and when handle 72 is manipulated to position cams 68 in the second position as best seen in FIG. 5 and with cord 50 having a generally U-shape extending around cam 62 and through the spacing between legs 16, device 60 can be initially inserted into the upper channel of rails 12 and positioned at any adjustable longitudinal position between the ends thereof. In the most preferred form, end caps 74 are friction fit in at least the upper channels of the opposite ends of rails 12 to prevent undesired removal of cam device 60 therefrom after initial insertion. When located at the desired longitudinal position, handle 72 can be manipulated to position cams 68 in the first position as best seen in FIG. 4 with cams 68 binding in the upper channels of rails 12 to thus lock cam device 60 at that position. It can also be appreciated that in the first position, cord 50 is held from sliding relative to cam 62 as it is bound between portions 22 and 66.

Further, while in the second position as best seen in FIG. 5, cord 50 can be pulled and slid relative to cam 62 such that the relative spacing or length of grips 52 and 54 from rails 12 can be adjusted. Specifically, depending upon several factors including the height of the user, the longitudinal position of cam device 60, and which grip 52 and 54 is desired to be utilized, cord 50 can be slid relative to cam device 60 such that the particular grip 52 or 54 desired to be utilized is positioned at the desired spacing from rails 12 while cam device 60 is in the second position as best seen in FIG. 5. It can be appreciated that the lengths of grips 52 and 54 from rails 12 are inversely related, i.e. as the length of grip 52 from rail 12 increases the length of grip 54 from rail 12 decreases and vice versa. At that time (and assuming that cam device 60 is at the desired longitudinal position along rail 12), cam device 60 can be rotated to the first position to bind cord 50 between portion 66 of cam 62 and connecting portions 22 (as well as locking cam device 60 at the desired longitudinal position along rail 12).

It should be noted that in the first position, portions 78 and 80 flushly abut on opposite sides of legs 16. Due to the planar nature of portions 78 and 80 and their preferred arrangement, cam device 60 has a home position and will not have a tendency to unintentionally rotate from the locked position. Similarly, the abutment of portions 80 and 84 on the opposite sides of legs 16 prevents handle 72 from pivoting beyond an acute angle in the order of 25° relative to rails 12 such that the free end of handle 72 is spaced from rails 12 and can be easily grasped or otherwise engaged to rotate cam device 60 from the unlocked position of FIG. 5 to the locked position of FIG. 4.

Now that the basic construction of apparatus 10 according to the preferred teachings of the present invention has been set forth, the operation and subtle features of apparatus 10 can be explained and appreciated. Specifically, to reduce carton size and for ease of handling, supports 24 are disassembled from rails 12 for shipping and handling. To reduce the amount of assembly required at the factory, nuts 34, cords 50, pivotable cam devices 60, and end caps 74 could also be dissassembled from rails 12 and assembled by the user after purchase. After purchase, supports 24 can be assembled to rails 12 at the desired longitudinal positions to match those of the legs of the particular stationary bicycle of the user and to position rails 12 relative to the stationary bicycle to allow securement locations of cords 50 to rails 12 to be at the desired positions. It can then be appreciated that supports 24 can be slid and adjustably secured at other positions relative to rails 12 when desired such as when a different stationary bicycle is purchased or if the desired securement locations of cords 50 to rails 12 and relative to the stationary bicycle should change.

After apparatus 10 has been fully assembled and the stationary bicycle supported thereon with rails 12 located on opposite sides of the stationary bicycle and the user supported thereon, the locations where cords 50 are secured to rails 12 can be adjusted. Specifically, handle 72 is manipulated to place cams 68 in the second position as best seen in FIG. 5 allowing pivotable cam devices 60 to be slid in rails 12 at any position between the first and second ends thereof. For example, the securement locations could be in back of the user on the stationary bicycle such that a forward pulling action is required to stretch cords 50, could be in front of the user on the stationary bicycle such that a rearward pulling action is required to stretch cords 50, could be directly below the user on the stationary bicycle such that a vertically upward pulling action is required to stretch cords 50, or at any of the positions therebetween. When pivotable cam devices 60 are at the desired securement locations and while pivotable cam devices 60 are in their second positions, cords 50 can be pulled to slide relative to cams 62 such that desired grips 52 or 54 are at the desired distance from rails 12 according to several factors including the height of the user, the securement locations of cords 50 to rails 12, the particular grips 52 or 54 selected and the like. The selection of grips 52 or 54 can depend upon several factors including the type of exercising stretch to be performed, the tastes of the user, and the like. It can be appreciated that tension of cords 50 is dependent on the amount stretched and thus the length of grips 52 or 54 from rails 12. After cords 50 are at the desired length, cam devices 60 can be pivoted from their second positions to their first positions to lock and secure cords 50 to rails 12 at the securement locations and to lock and prevent movement of cords 50 relative to cams 62.

It can then be appreciated that cords 50 on the opposite sides of apparatus 10 are independently adjustable such that cords 50 can be secured at the same or different longitudinal positions on rails 12 and can have the same or different lengths relative to rails 12. Towards that end, rails 12 and/or cords 50 can include markings or other forms of indicia to allow coordination from side to side. Due to the independence of adjustment, apparatus 10 according to the preferred teachings of the present invention can be adjusted to match the muscle strengths of the sides of the body of the particular user.

In typical use, while the user is peddling the stationary bicycle, grips 52 or 54 are pulled to stretch cords 50, with the tension increasing as cords 50 increase in length. Thus, the user can control the amount of tension by the amount of stretch given to cords 50. Likewise, cords 50 can be stretched slowly or fast depending on what is desired in intensity. Likewise, cords 50 can be gradually released with the user resisting the length decrease or can be released rapidly without resistance. Further, cords 50 can be stretched while the user is not peddling the stationary bicycle and while sitting on the seat. Typically, adjustment of apparatus 10 depending on whether or not peddling or both is desired is not required unless different direction of stretching is also desired. Thus, upper body exercise provided by apparatus 10 according to the teachings of the present invention is independent from the cycle action provided by the stationary bicycle and also has substantial variance.

Apparatus 10 according to the teachings of the present invention is advantageous when utilized with a stationary bicycle. Specifically, apparatus 10 provides upper body exercise in conjunction with the lower body exercise provided by the bicycle to increase the overall effectiveness of the work out. Additionally, since the user tends to be occupied with the strength exercises provided by apparatus 10 according to the teachings of the present invention, exercising is less tedious and monotonous than with the stationary bicycle alone. Furthermore, due to the adjustments in the position, length, and grips provided by apparatus 10 according to the teachings of the present invention, considerable variation is possible both physically but also mentally. Thus, more of an incentive exists to exercise with apparatus 10 according to the teachings of the present invention.

It should also be appreciated that apparatus 10 according to the preferred teachings of the present invention is sold separately from stationary bicycles and can be adjusted to fit existing bicycles. Thus, with the nominal expense for apparatus 10, the use and performance of an existing stationary bicycle is significantly improved. Further, there is no need to secure the bicycle to apparatus 10, with the weight of the bicycle and/or user being utilized to hold apparatus 10 stationary.

Now that the basic teachings of the present invention have been explained, many extensions and variations will be obvious to one skilled in the art. Although in the most preferred form several unique and novel features have been utilized producing synergistic results, such features could be utilized separately or in other combinations according to the teachings of the present invention.

For example, although cords 50 have been shown and described in the most preferred form as including grips 52 and 54 of different varieties at opposite ends thereof and is believed to be advantageous at least for providing grip options and maximizing length options of cords 50, cords 50 having a grip 52 or 54 or similar grip at only one end thereof could be utilized according to the teachings of the present invention.

Likewise, although cords 50 have been shown and described in the most preferred form to be elastic, cords 50 could take other forms according to the teachings of the present invention including springs, pulleys, or other methods of providing movement resistance.

Similarly, although cam devices 60 have been shown and described in the most preferred form as being pivotable between their first and second positions, cam devices 60 could take other forms such as but not limited to a two-piece, slideable design expandable and contractable between their first and second positions such as by rotating a knob or the like.

Further, although cords 50 in the most preferred form are slideably and adjustably secured to rails 12 by cam devices 60, other constructions can be utilized to slideably and adjustably secure cords 50 to rails 12 according to the preferred teachings of the present invention.

Furthermore, although cam devices 60 have been shown and described in the most preferred form as providing slideable and adjustable securement of cords 50 to rails 12 and also for providing adjustment of the lengths of cords 50 relative to rails 12, different devices can be utilized to perform these functions.

Also, cords 50 of differing diameters can be utilized with apparatus 10 according to the teachings of the present invention for differing tensional strengths. Likewise, more than one cord 50 could be utilized in each rail 12 of apparatus 10 according to the preferred teachings of the present invention.

Likewise, although apparatus 10 according to the preferred teachings of the present invention has been shown and described utilized with a stationary bicycle, apparatus 10 can have other applications according to the teachings of the present invention such as for use with step-up platforms, chairs, steppers, benches, boards, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparatus for exercising the upper body of a user comprising, in combination: at least a first longitudinal rail including first and second ends; a first cord having at least a first free end including a grip; and means for slideably and adjustably securing the first cord spaced from the free end to the first longitudinal rail at any location intermediate the first and second ends of the first longitudinal rail wherein said longitudinal rail includes a first channel including a longitudinally extending hollow interior having a width and a longitudinally extending opening to the hollow interior and having a width less than the width of the hollow interior with the core slidably and adjustably securing means located and slidable in the hollow interior—has been inserted after "rail".

2. The apparatus of claim 1 wherein the cord is of stretchable elastic; and wherein the apparatus further comprises, in combination: means for adjusting the length of the first free end of the cord from the longitudinal rail.

3. The apparatus of claim 2 wherein said cord extends through the opening and into the hollow interior having a width and a longitudinally extending opening to the hollow interior and having a width less than the width of the hollow interior, with the cord extending through the opening and into the hollow interior, with the cord slideably and adjustably securing means located and slideable in the hollow interior.

4. The apparatus of claim 3 wherein the cord slideably and adjustably securing means comprises, in combination: a channel cam located in the hollow interior having locked and unlocked positions, with the unlocked position being of a size allowing longitudinal sliding of the channel cam in the hollow interior, with the locked position being of a size for binding in the hollow interior and preventing sliding therein.

5. The apparatus of claim 4 wherein the channel cam is rotatable in the hollow interior between the locked and unlocked positions; and wherein the adjusting means comprises a cord cam integrally secured to the channel cam and rotatable therewith, with the cord cam including a first portion which allows the cord to pass through the hollow interior in the unlocked position and a second portion which compresses the cord in the hollow interior in the locked position.

6. The apparatus of claim 5 wherein the slideably and adjustably securing means further comprises, in combination: a handle including a neck extending through the opening and secured to the cord cam opposite to the first and second portions for rotating the channel cam between the locked and unlocked positions.

7. The apparatus of claim 4 wherein the channel cam is rotatable in the hollow interior between the locked and unlocked positions; and wherein the slideably and adjustably securing means further comprises, in combination: a handle including a neck extending through the opening and secured to the channel cam for rotating the channel cam between the locked and unlocked positions.

8. The apparatus of claim 2 wherein the cord has a second free end including a grip, wherein the cord is secured to the first longitudinal rail spaced from the second free end, with the length of the first free end from the longitudinal rail being inversely related to the length of the second free end from the longitudinal rail.

9. The apparatus of claim 8 wherein the grip of the first free end is parallel to the cord and the grip of the second free end is perpendicular to the cord.

10. Apparatus for exercising the upper body of a user comprising, in combination: a first longitudinal rail including first and second ends; a first cord having at least a free end including a grip; and means for slideably and adjustably securing the first cord spaced from the free end to the first longitudinal rail at any location intermediate the first and second ends of the first longitudinal rail, and further comprising, in combination: a second longitudinal rail including first and second ends, with the second longitudinal rail being parallel to the first longitudinal rail and spaced a distance sufficient to be located on the opposite side of the user; a second cord having at least a first free end including a grip; and means for slideably and adjustably securing the second cord spaced from the free end to the second longitudinal rail at any location intermediate the first and second ends of the second longitudinal rail and independent of the location of the first cord.

11. The apparatus of claim 10 further comprising, in combination: first and second supports each having first and second ends; means for slideably and adjustably securing the first ends of the first and second supports to the first longitudinal rail at spaced locations; and means for slideably and adjustably securing the second ends of the first and second supports to the second longitudinal rail at spaced locations.

12. The apparatus of claim 11 wherein the support slideably and adjustably securing means comprises, in combination: a nut, with each of the longitudinal rails including a first channel for slideably receiving the nut in a nonrotatable manner, with the first channel including a longitudinal slot; and a bolt extending through the support and the longitudinal slot and threaded into the nut slideably received in the first channel.

13. The apparatus of claim 12 wherein each of the longitudinal rails further includes a second channel including a longitudinally extending hollow interior having a width and a longitudinally extending opening to the hollow interior and having a width less than the width of the hollow interior, with the cord extending through the opening and into the hollow interior, with the cord slideably and adjustably securing means located and slideable in the hollow interior.

14. The apparatus of claim 11 wherein the first and second supports include upper surfaces adapted to receive legs of a stationary bicycle.

15. The apparatus of claim 1 wherein said cord extends through the opening and into the hollow interior having a width and a longitudinally extending opening to the hollow interior and having a width less than the width of the hollow interior, with the cord extending through the opening and into the hollow interior, with the cord slideably and adjustably securing means located and slideable in the hollow interior.

16. The apparatus of claim 15 wherein the cord slideably and adjustably securing means comprises, in combination: a channel cam located in the hollow interior having locked and unlocked positions, with the unlocked position being of a size allowing longitudinal sliding of the channel cam in the hollow interior, with the locked position being of a size for binding in the hollow interior and preventing sliding therein.

17. The apparatus of claim 16 wherein the opening is defined by at least a first leg having an inside surface located in the hollow interior of the first channel; wherein the channel cam is rotatable in the hollow interior between the locked and unlocked positions; and wherein the channel cam includes a planar portion which abuts with the inside surface of the leg when the channel cam is located in the locked position.

18. The apparatus of claim 17 wherein the slideably and adjustably securing means further comprises, in combination: a handle including a neck extending through the opening and secured to the channel cam for rotating the channel cam between the locked and unlocked positions; wherein the first leg includes an outside surface parallel to the inside surface; and wherein the handle includes a first planar portion parallel to, spaced, and offset from the planar portion of the channel cam, with the planar portion abutting with the outside surface of the leg when the channel cam is located in the locked position.

19. The apparatus of claim 18 wherein the handle includes a free end and a second planar portion at an angle to the first planar portion, with the second planar portion abutting with the outside surface of the leg when the channel cam is located in the unlocked position for holding the free end of the handle spaced from the longitudinal rail.

* * * * *

UNITED STATES PATENT AND TRADEMARK OFFICE
CERTIFICATE OF CORRECTION

PATENT NO. : 5,429,565

DATED : July 4, 1995

INVENTOR(S) : Vernon A. Hagg et al.

It is certified that error appears in the above-identified patent and that said Letters Patent is hereby corrected as shown below:

Title page, item [56], before "Primary Examiner--Stephen R. Crow" insert --OTHER PUBLICATIONS--
NordicTrack "Fitness At Home™" ©1993 Nordic Track, Inc., a CML Company, Lit. #06020-0300, Cover page, Pages 11, 27, last page--.

Column 9, lines 32-33, cancel "--has been inserted after 'rail'".

Column 9, lines 40-46, cancel "having a width and..." through and including "...slideable in the hollow interior".

Column 10, last line-column 11, line 5, cancel "having a width and..." through and including "...and slideable in the hollow interior".

Signed and Sealed this

Seventeenth Day of October, 1995

*Attest:*

Bruce Lehman

BRUCE LEHMAN

*Attesting Officer*

*Commissioner of Patents and Trademarks*